US007607629B1

(12) United States Patent
Carrasco et al.

(10) Patent No.: US 7,607,629 B1
(45) Date of Patent: Oct. 27, 2009

(54) DETACHABLE MUSICAL BASE FOR BABY BOTTLE

(76) Inventors: Raymond Carrasco, 6130 Lincold Ave., South Gate, CA (US) 90280; Maria Carrasco, 6130 Lincoln Ave., South Gate, CA (US) 90280

( * ) Notice: Subject to any disclaimer, the term of this patent is extended or adjusted under 35 U.S.C. 154(b) by 551 days.

(21) Appl. No.: 11/454,037

(22) Filed: Jun. 16, 2006

(51) Int. Cl.
*A47B 91/10* (2006.01)
*A63H 33/00* (2006.01)

(52) U.S. Cl. ..... 248/346.07; 248/102; 248/313; 446/77; 446/227

(58) Field of Classification Search ..... 248/311.2, 248/313, 309.1, 104, 154, 346.06; 446/73, 446/74, 77, 227, 297, 404; 215/11.1
See application file for complete search history.

(56) References Cited

U.S. PATENT DOCUMENTS 4,678,093 A 7/1987 Allen
4,898,060 A * 2/1990 To ..... 446/227
4,944,704 A 7/1990 Grace
5,054,733 A * 10/1991 Shields ..... 248/313
5,143,338 A * 9/1992 Eberlin ..... 248/313
5,149,032 A * 9/1992 Jones et al. ..... 248/154
5,344,034 A * 9/1994 Eagan ..... 446/227
5,560,578 A * 10/1996 Schenken et al. ..... 248/313
5,664,745 A 9/1997 Hadaway
5,842,901 A * 12/1998 Montgomery ..... 446/77
6,413,137 B1 * 7/2002 Myers, Sr. ..... 446/77
6,419,198 B1 * 7/2002 Einav ..... 248/346.07
6,443,800 B1 * 9/2002 Rice ..... 446/227
6,598,838 B2 * 7/2003 Suh ..... 248/104

* cited by examiner

*Primary Examiner*—Amy J. Sterling
*Assistant Examiner*—Tan Le
(74) *Attorney, Agent, or Firm*—Cislo & Thomas, LLP

(57) ABSTRACT

A detachable music box for a baby bottle is comprised of a body structure having a base for resting upon a horizontal surface to support the baby bottle thereon in a stable manner. A musical sound player is housed within the body structure. A bottle seat is located at the top of the base and includes a bottle clamp for gripping the sides of the baby bottle to thereby releasably secure the body structure to the baby bottle. The bottle clamp may alternatively release the body structure from the baby bottle. The clamping mechanism thereby allows the detachable music box to be releasably attached to baby bottles having physical sizes and shapes that differ significantly from each other.

16 Claims, 6 Drawing Sheets

DETACHABLE MUSICAL BASE FOR BABY BOTTLE

BACKGROUND OF THE INVENTION

1. Field of the Invention

The present invention relates to an accessory for a baby feeding bottle that contains a music producing device and upon which the baby feeding bottle may be seated and to which the baby feeding bottle may be releasably clamped.

2. Description of the Prior Art

Baby bottles have been in continuous use for many, many years for nursing and feeding liquids to infant children. Conventional baby bottles are formed as elongated, tubular containers of glass or plastic having a closed bottom end and an open mouth at the opposite, top end. Rubber nipples are releasably secured to the open, top ends of conventional bottles by means of annular plastic collars which provide a liquid-tight seal at the mouth of the bottle. Conventional infant feeding bottles of this type may be cylindrical in cross-sectional shape, but are sometimes formed with polygonal outer cross-sectional configurations.

Infant children are often quite temperamental during feeding. The distress of many infants during feeding may be relieved by playing soothing music to the infant. In many cases music relaxes and calms the child so that the infant is able to take nourishment without agitation by sucking liquid from the bottle through the nipple.

The soothing and calming effect of music has been used to advantage in a wide variety of children's products. Stuffed animals, mobiles, and dolls have all been manufactured with internal music boxes designed to capture and hold the attention of infant children and newborn babies.

Various liquid containers for feeding infants have been devised that contain music players for providing soothing music to calm a distressed infant. However, conventional musical baby feed bottles either require a bottle with a music player permanently attached thereto, or involve a musical baby bottle attachment that can only accommodate baby bottles of a specific size and shape. For example, U.S. Pat. No. 5,664,745 discloses a musical baby bottle adapter having a top chamber with an open ended cylinder that receives the bottom of a baby feeding bottle. However, such an adapter can only accommodate baby feeding bottles of a specific size and shape. U.S. Pat. Nos. 4,898,060 and 4,944,704 disclose especially configured baby bottles to which specially configured musical bases are attached.

SUMMARY OF THE INVENTION

The present invention is an accessory or attachment for a baby feeding bottle that contains a music player and which has a unique system for releaseable attachment to baby feeding bottles of widely differing sizes and shapes. Furthermore, the detachable, musical baby bottle accessory of the invention may be easily and quickly secured to the lower portion of a conventional baby feeding bottle and will remain securely affixed thereto when desired. On the other hand, the detachable accessory may be just as easily released from the baby feeding bottle to permit the bottle to be washed or refilled and heated.

The quick coupling and decoupling mechanism of the musical baby feeding bottle attachment is quite simple in mechanical operation and very durable in construction. Consequently, it will not become damaged by a fall from between the bars of a baby's crib, or by impacts from other causes. The musical baby bottle attachment of the invention is constructed so that it can be engaged with the bottom of the baby feeding bottle very securely and very quickly. It can be detached from the baby bottle just as easily. Furthermore, the musical baby feeding bottle attachment of the invention will securely grip the vast majority of commercially available baby bottles that are currently utilized for infant feeding.

In one broad aspect the present invention may be considered to be an attachment for a baby feeding bottle having a bottom and upright side surfaces. The attachment of the invention is comprised of a seat, a music producing device, and a releaseable clamp mechanism. The seat receives the bottom of the baby feeding bottle. The music producing device is located within the seat. The releaseable clamp mechanism on the seat is operable to exert compressive forces from opposing directions against the side surfaces of the baby feeding bottle, and in the alternative is operable to release the side surfaces of the baby feeding bottle.

Preferably, the clamp mechanism includes at least one pair of opposing jaws facing each other and mounted upon opposing sides of the seat, and gear elements coupling the jaws together and movable in a first direction to draw the jaws toward each other and in an opposite direction to force the jaws apart from each other. Guide slots are preferably formed in the seat and a pair of transversely extending clamp arms are provided. Each of the jaws is mounted upon one of the transversely extending clamp arms.

The clamp arms for the jaws in each pair of jaws are disposed in mutual parallel alignment with each other and move in the guide slots formed in the seat. The transversely extending clamp arms for each pair of jaws are mounted for mutually parallel, reciprocal movement in a common clamp arm plane for that pair of jaws relative to the seat. Each of the clamp arms carries a separate one of the jaws at one of its extremities. The clamp arms have mutually facing longitudinal edges formed with teeth. The gear elements further include a pinion having an axis of rotation. The pinion is located between and engaged with the teeth on the clamp arms. The pinion axis of rotation is perpendicular to the clamp arm plane. In this way the pinion and the gear teeth on the clamp arms are engaged to form a rack and pinion jaw advancement and jaw retraction mechanism.

The baby feeding bottle attachment is further comprised of a manually operated latch engageable with the releaseable clamp mechanism to selectively permit and prevent movement of the jaws. The latch is a lever with an outboard operating end protruding from the seat. The latch has a toothed inboard end engageable with the pinion. The latch is rotatably mounted to the seat for rotation about a latch axis that is offset from and parallel to the pinion axis of rotation.

A detent is preferably provided on the seat. The latch moves past the detent when it is rotated about the latch axis. The detent thereby tends to hold the latch lever alternatively engaged with and disengaged from the rack and pinion gearing, as selected by the user.

In a preferred embodiment of the invention the seat has an axial center and the releaseable clamp mechanism includes two pairs of opposing jaws. The jaws within each pair face each other and are mounted upon opposing sides of the axial center of the seat from each other. The pairs of jaws are oriented at right angles relative to each other. A retraction system is provided for concurrently moving all of the jaws toward the axial center of the seat and an extension system is provided for concurrently pushing the jaws away from the axial center of the seat. The retraction and extension systems are preferably comprised of rack and pinion gearing.

Each of the jaws is mounted upon an outboard end of a separate arm. The support arms each have a toothed side that forms a gear rack. A pinion is provided having an axis of rotation located at the axial center of the seat. The pinion is engaged with all of the gear racks so that rotation of the pinion in one direction of rotation concurrently draws all of the racks toward the axial center of the seat. Rotation of the pinion in an opposite direction of rotation pushes the jaws apart from each other and away from the axial center of the seat.

In another aspect the invention may be considered to be a detachable baby bottle accessory comprising a base, a music player, at least one pair of opposing jaws, and a jaw adjustment mechanism. The base can support a baby bottle from beneath upon a flat surface. The music player is located within the base. Each pair of opposing jaws is located atop the base for receiving the baby bottle therebetween. The jaw adjustment mechanism moves at least one of the jaws in each pair to clamp the baby bottle between the jaws. Alternatively, the jaw adjustment mechanism releases the baby bottle from between the jaws.

In still another aspect the invention may be considered to be a detachable music box for a baby bottle. The detachable music box is comprised of a body structure, a musical sound player, and a bottle seat including a bottle clamp. The body structure has a base for resting upon a horizontal surface to support the body structure thereon in a stable manner. The musical sound player is housed within the body structure. The bottle seat is located at the top of the base. The bottle clamp grips the bottle to thereby releasably secure the body structure to the baby bottle, and to alternatively release the body structure from the baby bottle.

The invention may be described with greater clarity and particularity by reference to the accompanying drawings.

DESCRIPTION OF THE EMBODIMENT

Figure 1:
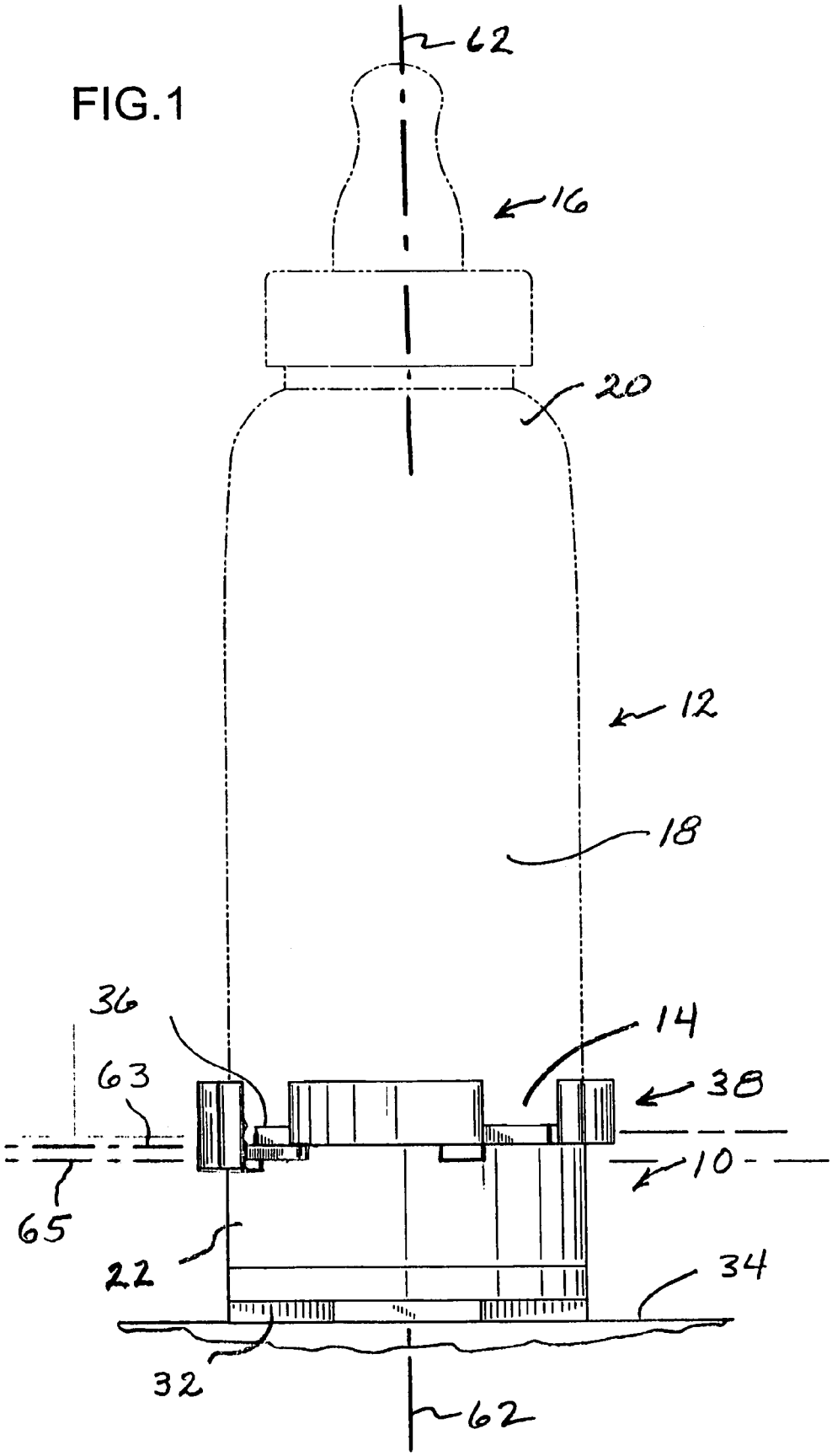
FIG. 1 is a side elevational view illustrating a detachable baby bottle accessory according to the invention with a conventional baby bottle seated therein shown in phantom.

FIG. 1 illustrates an attachment or accessory generally at 10 for use with a baby feeding bottle indicated at 12. The baby feeding bottle 12 is a conventional baby bottle which may have cylindrical shape, or the shape generally of a hexagonal or octagonal prism, all of which are commercially available. The geometric shape and cross-sectional area of the baby feeding bottle 12 may vary considerably.

Most, if not all, commercially available baby bottles have a generally flat bottom 14 opposite the upper end at which a baby feeding nipple 16 is coupled to the mouth of the baby bottle. Baby feeding bottles 12 of the type shown have upright side walls 18 that typically define an interior bottle cavity of generally uniform cross section from the bottom 14 of the baby feeding bottle 12 up to the shoulders 20, which narrow to form the mouth to which the nipple 16 is coupled.

Figure 4:
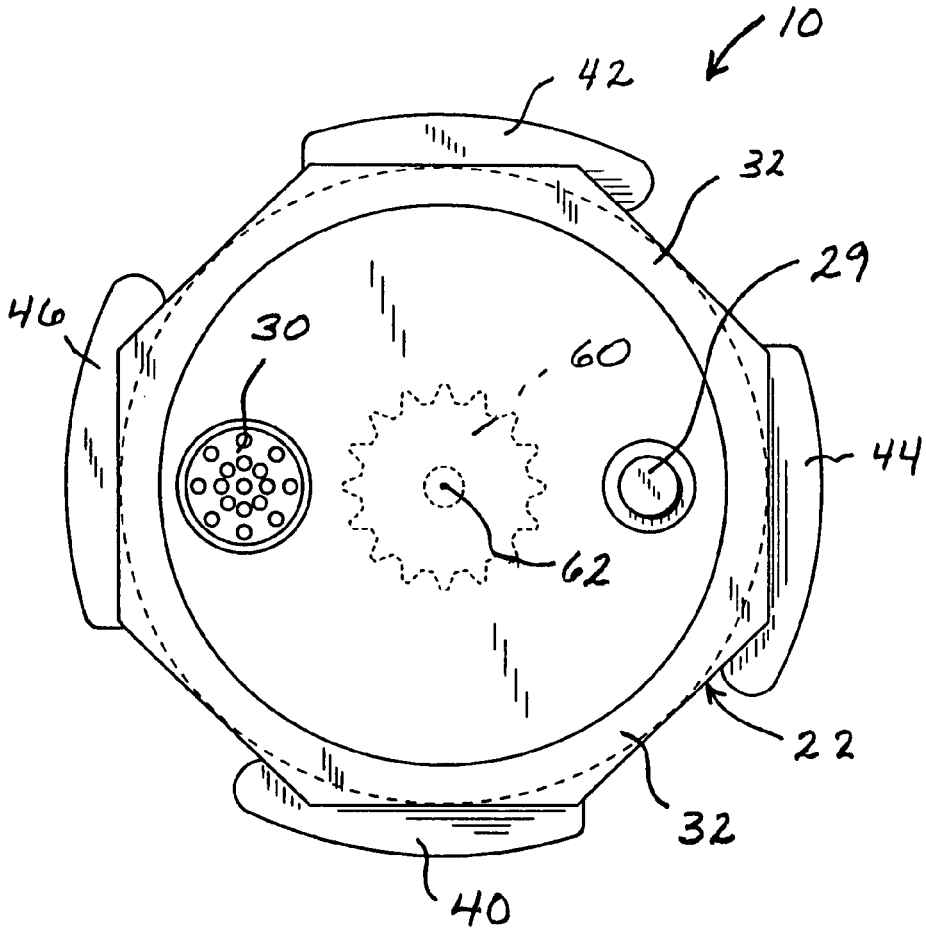
FIG. 4 is a bottom plan view of the baby bottle attachment of the invention.
Figure 5:
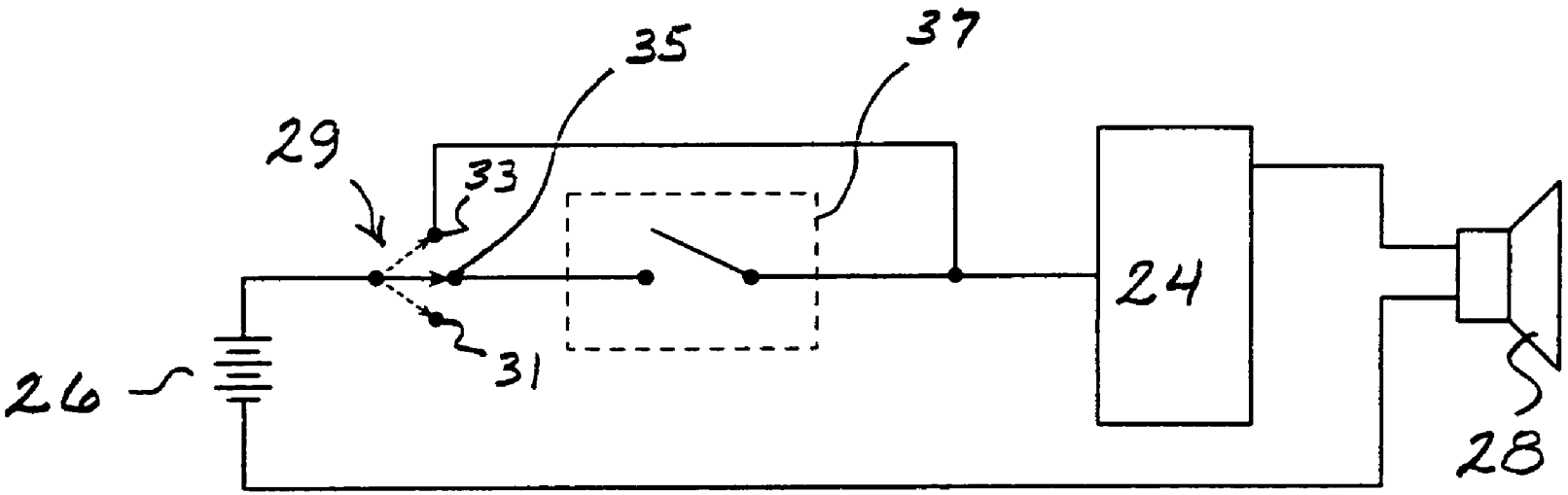
FIG. 5 is an electrical schematic diagram showing the operation of the music player in the baby feeding bottle attachment of the invention.

The baby feeding bottle attachment 10 has a body portion 22 that houses a music player 24, indicated in FIG. 5. The music player 24 may be any conventional type of music playing device, such as an electrically operated audio tape player powered by a battery 26 which is also housed within the body portion 22. The music player 24 is electrically connected to a speaker 28, which is positioned to face a perforated speaker panel 30, shown in FIG. 4, in the underside of the body portion 22. The annular, depending, peripheral rim 32 at the bottom of the musical baby feeding bottle accessory 10, illustrated in FIG. 4, forms a stand for supporting the baby bottle 12 from beneath upon a flat surface, indicated at 34 in FIG. 1.

An electrical push button switch 29, shown in FIGS. 4 and 5, may be connected between the battery 26 and the music player 24 to control operation of the music player 24. As shown in FIG. 5 the switch 29 may be a three-way, push button switch which may be toggled to alternatively turn the music player to an OFF position, indicated at 31, to a continuously ON position, indicated at 33, and to a position 35 in which the music player 24 is actuated or deactuated under the control of a position sensitive device 37. That is, the position sensitive device 37 may turn the music player 24 OFF when the bottle 12 is in the upright position depicted in FIG. 1 and alternatively turn the music player 24 ON when the bottle is tilted. One suitable position sensitive switching mechanism 37 is illustrated and described, for example, in our prior U.S. application Ser. No. 10/750,729 filed Jan. 5, 2004. This prior application is hereby incorporated herein by reference in its entirety.

The novel feature of the detachable baby bottle accessory 10 of the present invention is the mechanism by which the accessory 10 is attached to and detaches from the baby feeding bottle 12. As illustrated in FIG. 3A, there is a disc-shaped seating platform 36 mounted atop the body portion 22 to form a seat for receiving the bottom 14 of the baby feeding bottle 12. The diameter of the seating platform 36 is no greater that the width of the smallest baby feeding bottle 12 which the attachment 10 can accommodate.

A releaseable clamp mechanism 38 is mounted upon the body portion 22 beneath the seat 36 for exerting compressive forces from opposing directions against the side surfaces 18 of the baby bottle 12 at the bottom 14 thereof. In the alternative the releaseable clamp mechanism 38 is operable to release the side surfaces 18 of the baby bottle 12.

Figure 2:
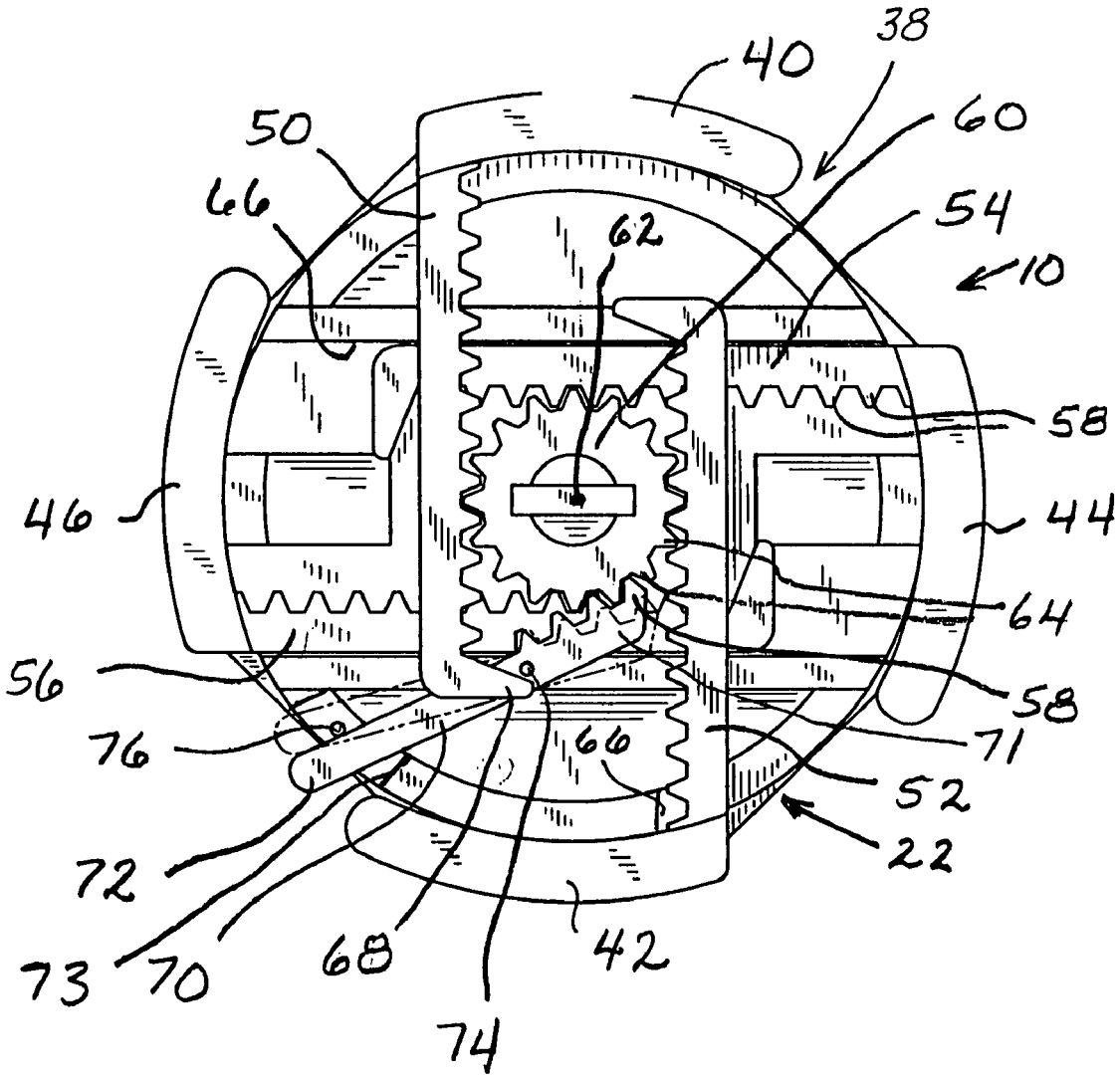
FIG. 2 is a top plan view of the musical baby feeding bottle attachment of the invention showing the clamping jaws thereof immobilized and with the bottle seating platform removed to allow illustration of the rack and pinion gearing.
Figure 3:
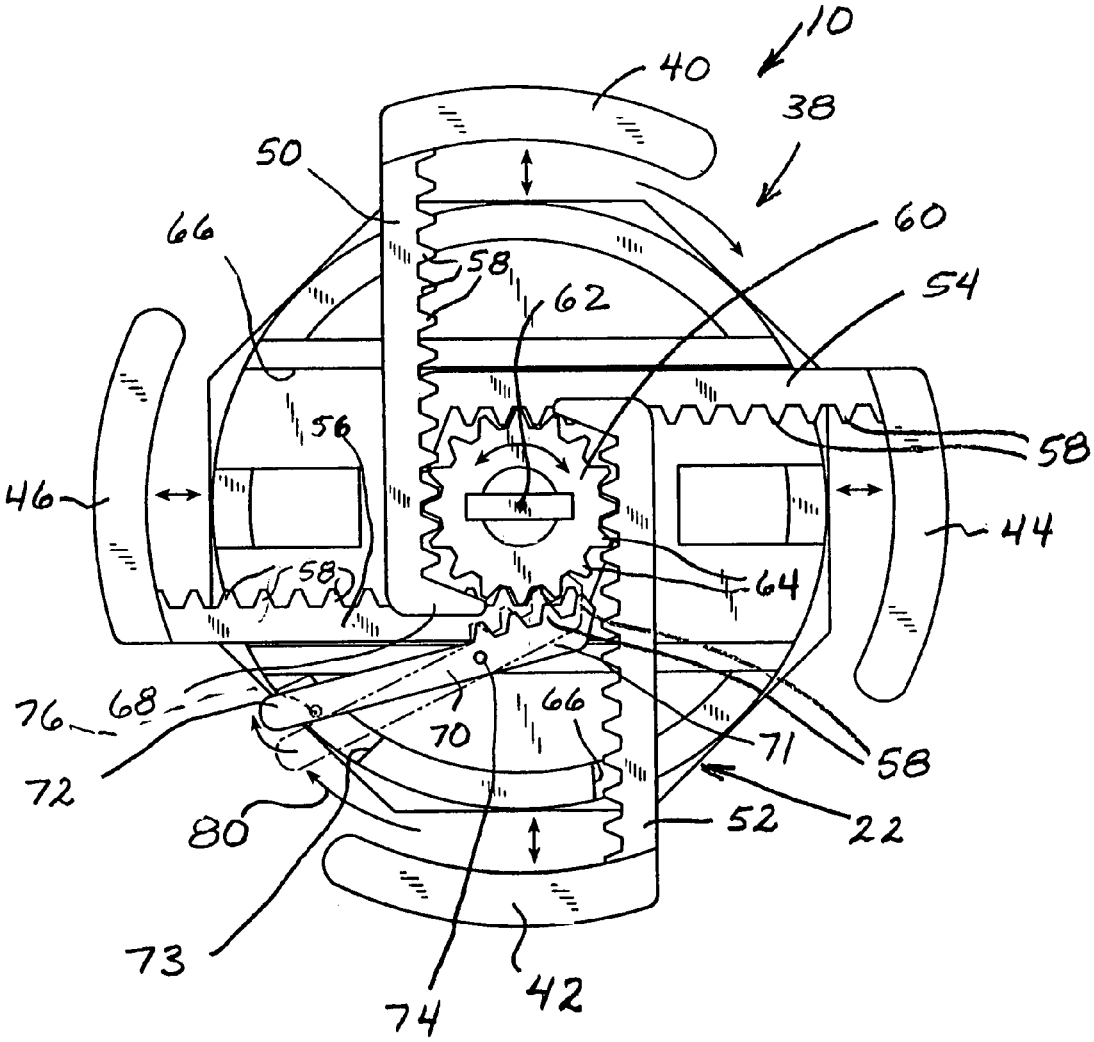
FIG. 3 is a top plan view of the baby feeding bottle attachment showing the clamping jaws thereof when retracted and extended and with the bottle seating platform removed to allow illustration of the rack and pinion gearing.
Figure 3A:
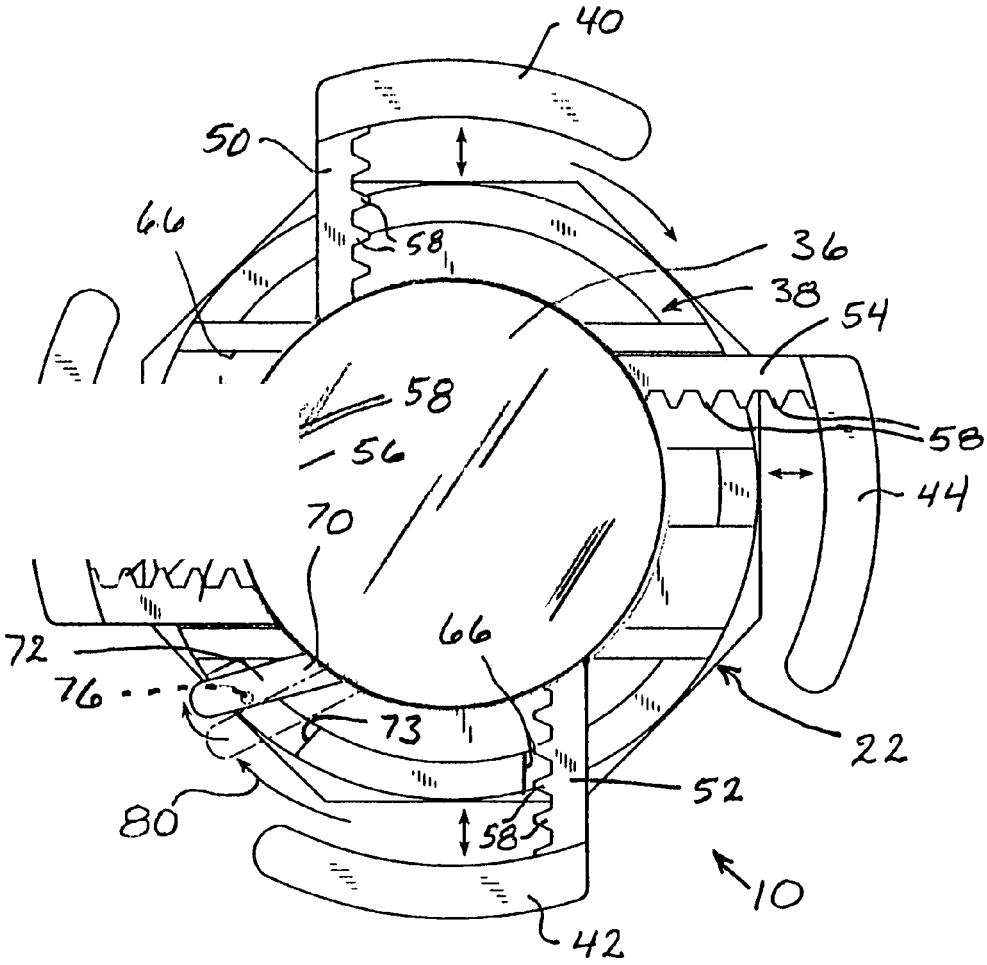
FIG. 3A is a top plan view of the baby feeding bottle attachment with the bottle seating platform shown in position.

The releaseable clamp mechanism 38 is comprised of at least one pair, and preferably two pairs of opposing clamping jaws 40,42 and 44,46 which are respectively mounted upon transversely oriented clamping jaw support arms 50, 52, 54, and 56, as shown in FIGS. 2 and 3. The seating platform 36 is removed in the drawing views of FIGS. 2 and 3 to allow illustration of the rack pinion gearing that operates the clamping jaws 40, 42, 44, and 46.

The clamping jaws 40, 42, 44, and 46 each have a generally arcuate-shaped configuration, curved concave facing the axial center of the body portion 22, which is indicated as an axis 62 in the drawings. The support arms are arranged in two pairs, 50,52 and 54,56. The support arms within each pair are mutually parallel to each other. That is, the support arms 50 and 52 in the first pair of support arms are mutually parallel to each other. The support arms 54 and 56 in the second pair of support arms are likewise mutually parallel to each other.

All of the support arms 50, 52, 54, and 56 have interior side edges that are formed with a plurality of teeth 58 thereon. The toothed edges of the support arms 50, 52, 54, and 56 thereby are formed as toothed racks comprising part of a rack and pinion gearing system. The toothed racks formed on the support arms in each pair reside in mutually coplanar relationship to each other and face each other on opposite sides of the axial center 62 of the body portion 22, as illustrated in FIGS. 2 and 3. That is, the toothed racks of teeth 58 formed on the mutually facing edges of the support arms 50 and 52 reside in a common plane 63 with each other. Similarly, the toothed racks on the support arms 54 and 56 likewise reside in a common plane 65 with each other that is parallel to and located beneath the plane 63 of the toothed racks on the support arms 50 and 52. The support arms 50 and 52 for the first pair of jaws 40 and 42 reside in the first horizontal support arm plane 63 parallel to and above the second, horizontal support arm plane 65 in which the support arms 54 and 56 for the other pair of jaws 44 and 46 reside. The planes 63 and 65 are spaced longitudinally from each other and are both perpendicular to the axial center 62 of the body portion 22. The seating platform 36 is also horizontal and is located above the level of the plane 63 and is parallel to both of the planes 63 and 65.

The rack and pinion gearing system is further comprised of a pinion 60 that extends longitudinally and vertically between the first and second support arm planes 63 and 65. The pinion 60 is mounted for rotation on the body portion or base 22 about the pinion axis of rotation. The pinion 60 is located at the axial center of the body portion 22 and has an axis of rotation that is coaxial with the alignment of the baby feeding bottle 12 and which coincides with the body portion axis 62. The pinion 60 extends vertically between and beyond both the first support arm plane 63 and the second support arm plane 65 in which the support arms 50,52 and 54,56 are respectively located.

The pinion 60 has teeth 64 defined in its periphery throughout its length. The pinion teeth 64 are configured to mesh with the teeth 58 on the toothed racks formed on the jaw support arms 50, 52, 54, and 56. The upper portions of the teeth 64 engage the teeth 58 in the toothed racks on the support arms 50 and 52 that reside in the first, upper plane 63. The lower portions of the teeth 64 of the pinion 60 engage teeth 58 on the toothed racks on the support arms 54 and 56 that reside in the second, lower plane 65.

Because the jaw support arms 54 and 56 are located at a lower level on the body portion 22 than the jaw arms 50 and 52, the jaws 44 and 46 are taller in a vertical or longitudinal direction than the jaws 40 and 42. All of the jaws 40, 42, 44, and 46 thereby grip the side walls 18 of the base 14 of the baby bottle 12 at the same vertical level above the seating platform 36.

The body portion 22 of the detachable baby bottle accessory 10 is formed with transversely oriented slots 66 in the outer wall of its structure to accommodate the presence and allow reciprocal movement of the jaw support arms 50, 52, 54, and 56. Each of the jaw support arms has a retaining foot 68 on its end extremity remote from the jaw which it supports. The retaining feet 68 prevent the jaw support arms 50, 52, 54, and 56 from being pulled completely out of the slots 66 in the body portion 22.

The detachable baby bottle accessory 10 is provided with a pinion latch lever 70 that has an interior end 71 with teeth 58 formed thereon that mesh with the teeth 64 of the pinion 60. The pinion latch lever 60 has an opposite, outboard operating end 72 that protrudes outwardly from the body portion 22 so that it can be adjusted by the user. The latch lever arm 70 is mounted to the body portion 22 for rotation about a latch axis formed by a vertical latch pin 74. The latch pin 74 mounts the latch lever arm 70 to the body portion 22 for rotation about a latch axis that is offset from and parallel to the pinion axis of rotation which also the axial center 62 of the body portion 22.

As illustrated in FIGS. 2 and 3, the operating end 72 of the latch lever arm 70 may be rotated relative to the body portion 22 in opposing directions to either engage the latch lever arm teeth 58 with the pinion teeth 64, as illustrated in FIG. 2, or disengage the latch lever arm teeth 58 from the pinion teeth 64, as illustrated in FIG. 3. The latch lever arm 70 is rotatable in a plane that is parallel to and which lies between the first jaw support arm plane 63 and the second jaw support arm plane 65. A slot 73 is defined in the structure of the body portion 22 to allow movement of the operating end 72 of the latch lever arm 70.

The body portion 22 of the baby feeding bottle accessory 10 is provided with a detent 76. The detent 76 is a rounded plastic boss located in the slot 73 in the body portion 22 through which the outboard operating end 72 of the latching lever 70 projects. The detent boss 76 is located at the center of the slot 73. The operating end 72 of the latch lever arm 70 is moved past the detent boss 76 when the latch lever 70 is rotated about the axis 74 of the latch pin. The latch lever 70 is flexible enough so that the operating end 72 of the latch lever 70 can move past the detent boss 76 when the latch lever 70 is rotated in either the clockwise or counterclockwise directions, as viewed in FIGS. 2 and 3. However, the detent boss 76 tends to hold the teeth 58 of the latch lever 70 alternatively either engaged with the teeth 64 of the pinion 60 in the rack and pinion gearing system as illustrated in FIG. 2, or disengaged from the pinion teeth 64, as illustrated in FIG. 3.

As illustrated in FIGS. 2 and 3, the pairs of jaws 40,42 and 44,46 are oriented at right angles relative to each other. With the bottom 14 of the baby bottle 12 seated on the seating platform 36 atop the body portion 22, within the lateral confines of the jaws 40, 42, 44, and 46, the jaws in either of the opposing pairs may be pressed toward each other when latch lever arm 70 is moved to the disengaged position illustrated in FIG. 3. Opposing inward pressure against the jaws 40 and 42 in the first pair of jaws, for example, causes the racks on the jaw support arms 50 and 52 to rotate the pinion 60 in a counterclockwise direction, as viewed in FIG. 3. The pinion 60 also engages the racks on the lower set of support arms 54 and 56, so that its counterclockwise rotation, as viewed in FIG. 3, also causes the jaws 44 and 46 to be pressed inwardly against the side walls 18 of the baby bottle 12. Once the concave surfaces of all four of the jaws 40, 42, 44, and 46 are pressed against and in contact with the side walls 18 of the baby feeding bottle 12, the user rotates the latch lever arm 70 in a counterclockwise direction, as viewed in FIGS. 2 and 3, to move the latch lever 70 from the disengaged position illustrated in FIG. 3, to the engaged position illustrated in FIG. 2. In moving the latch lever arm 70 from the disengaged to the engaged position, the operating end 72 of the latch lever arm 70 must be pushed past the detent boss 76, which thereafter holds the latch lever arm 70 in the engaged position, as illustrated in FIG. 2.

When the jaws 40, 42, 44, and 46 of the releaseable clamp mechanism of the invention are pushed in against the side walls 18 of the baby bottle 12, and the latch lever arm is moved to the locked position, illustrated in FIG. 2, the baby feeding bottle accessory 10 tightly grips the side walls 18 of the baby feeding bottle 12 adjacent the bottom 14 thereof. The baby feeding bottle 12 is then lifted and tilted to the baby feeding position, with the detachable musical accessory 10 securely, but releasably fastened to the bottom 14 of the baby feeding bottle 12. The music player 24 can then be actuated, deactuated, or conditionally actuated by sequential depression of the stepping switch button 29 on the bottom of the detachable accessory 10.

The rack and pinion clamping system of the invention may be easily operated to detach the accessory 10 from the bottom 14 of the baby bottle 12. This is quickly accomplished by rotating the latching lever arm 70 from the locked position shown in FIG. 2 to the disengaged position shown in FIG. 3, simply by pushing the outboard, operating end 72 of the latching lever 70 in a clockwise direction, as indicated by the directional arrow 80 in FIG. 3. Rotation of the latch lever arm 70 in the clockwise direction about its latch pin 74 withdraws the latch arm teeth 58 from engagement with the teeth 64 of the pinion 60, as illustrated in FIG. 3. The jaws 40, 42, 44, and 46 of the clamping system thereupon no longer tightly grip the side walls 18 of the baby feeding bottle 12. To the contrary, when latching arm 70 is rotated past the detent 76 to the released position illustrated in FIG. 3, the baby feeding bottle 12 can be easily lifted out of the seat formed by the seat platform 36 at the top of the body portion 22 of the musical baby bottle accessory 10. With the latching lever arm 70 in the position illustrated in FIG. 3, any of the opposing jaws 40,42 and 44,46 may be easily drawn apart if there is any resistance whatsoever to withdrawal of the baby feeding bottle 12 from the musical baby bottle accessory 10.

The single pinion 60 employed in the musical baby bottle accessory 10 is mounted to the body member 22 for rotation relative thereto and is engaged concurrently with all of the toothed racks formed on the jaw support arms 50, 52, 54, and 56. The pinion 60 is rotatable in a first direction, namely a clockwise direction, to concurrently draw all of the jaws 40, 42, 44, and 46 radially toward each other when the latching lever 70 is in the released position depicted in FIG. 3. Alternatively, the pinion 60 is rotatable in the opposite, counterclockwise direction to concurrently push all of the jaws 40, 42, 44, and 46 radially apart when the latch lever arm 70 is in the released position of FIG. 3. When the latch lever arm 70 is in the engaged position depicted in FIG. 2, the pinion 60 is immobilized relative to the body member 22, as are the jaws 40, 42, 44, and 46. The detent 76 on the body member 22 holds the latching lever arm 70 in a selected position of engagement (FIG. 2) and alternatively in a position of disengagement (FIG. 3) relative to the pinion 60.

The rack and pinion gearing formed by the racks on the jaw support arms 50, 52, 54, and 56 and by the pinion 60 comprise a retraction system for concurrently moving all of the jaws 40, 42, 44, and 46 toward the axial center 62 of the body portion 22. These same rack and pinion elements also serve as an extension system for concurrently pushing the jaws 40, 42, 44, and 46 away from the axial center 62 of the body portion 22. The manually operated latch lever arm 70 serves as a releaseable locking mechanism for engaging the pinion 60 to selectively permit and prevent movement of the jaws 40, 42, 44, and 46.

Undoubtedly, numerous variations and modifications of the present invention will become readily apparent to those familiar with musical baby feeding bottles. For example, the releaseable clamp mechanism could be formed with a retractable and extendable radial band like an oil filter wrench, rather than with a rack and pinion gear system. Accordingly, the scope of the invention should not be construed as limited to the specific embodiment depicted and described, but rather is defined in the claims appended hereto.

We claim:

1. A removable attachment for a baby feeding bottle having a bottom and upright side surfaces comprising:

a seat for receiving said bottom of said baby feeding bottle, a music producing device located within said seat, a releaseable clamp mechanism on said seat for exerting compressive forces from opposing directions, against said side surfaces of said baby feeding bottle and in the alternative releasing said side surfaces of said baby feeding bottle, wherein said releaseable clamp mechanism includes at least one pair of opposing jaws facing each other and mounted upon opposing sides of said seat and gear elements coupling said jaws together and movable in a first direction to draw said jaws toward each other and in a second opposite direction to force said jaws apart from each other; and guide slots in said seat, and said gear elements include a pair of transversely extending clamp arms mounted within said guide slots for mutually parallel reciprocal movement in a common clamp arm plane relative to said seat, and each of said clamp arms carries a separate one of said jaws at one of its extremities, and said clamp arms have mutually facing longitudinal edges formed with teeth, and said gear elements further include a pinion having a pinion axis of rotation and located between and engaged with said teeth on said clamp arms and said pinion axis of rotation is perpendicular to said clamp arm plane, whereby said pinion and said gear teeth on said clamp arms are engaged to form a rack and pinion jaw advancement and jaw retraction mechanism.

2. An attachment according to claim 1 further comprising a manually operated latch engageable with said releaseable clamp mechanism to selectively permit and prevent movement of said jaws.

3. An attachment according to claim 2 wherein said latch is a lever with an outboard operating end protruding from said seat, a toothed inboard end engageable with said pinion, and said latch is rotatably mounted to said seat for rotation about a latch axis offset from and parallel to said pinion axis of rotation.

4. An attachment according to claim 3 further comprising a detent on said seat past which said operating end of said latch moves when said latch is rotated about said latch axis, so that said detent tends to hold said lever alternatively engaged with and disengaged from said rack and pinion gearing.

5. A removable attachment for a baby feeding bottle having a bottom and upright side surfaces comprising:

a seat for receiving said bottom of said baby feeding bottle, a music producing device located within said seat, a releaseable clamp mechanism on said seat for exerting compressive forces from opposing directions, against said side surfaces of said baby feeding bottle and in the alternative releasing said side surfaces of said baby feeding bottle; and wherein said seat has an axial center and said releaseable clamp mechanism includes two pairs of opposing jaws, wherein said jaws within each pair face each other and are mounted upon opposing sides of said axial center of said seat from each other, and said pairs of jaws are oriented at right angles relative to each other, and further comprising a retraction system for concurrently moving all of said jaws toward said axial center of said seat and an extension system for concurrently pushing said jaws away from said axial center of said seat.

6. An attachment according to claim 5 wherein said retraction and extension systems are comprised of rack and pinion gearing.

7. An attachment according to claim 6 wherein each of said jaws is mounted upon an outboard end of a separate support arm, and said support arms each have a toothed side that forms a gear rack, and further comprising a pinion having an axis of rotation located at said axial center of said seat, and said pinion is engaged with all of said gear racks so that rotation of said pinion in one direction of rotation concurrently draws all of said jaws toward said axial center of said seat and rotation of said pinion in an opposite direction of rotation pushes said jaws apart from each other and away from said axial center of said seat.

8. An attachment according to claim 7 further comprising a pinion latch mounted on said seat and rotatable about a latch axis of rotation offset from and parallel to said axis of rotation of said pinion and said pinion latch is engageable with said pinion to immobilize said pinion from rotation relative to said seat and disengageable from said pinion to permit said pinion to rotate relative to said seat.

9. An attachment according to claim 8 further comprising a detent on said seat for holding said pinion latch in engagement and alternatively in disengagement with said pinion.

10. A detachable baby bottle accessory comprising:

a base for supporting a baby bottle from beneath upon a flat surface, a music player located within said base, at least one pair of opposing jaws located atop said base for receiving said baby bottle therebetween, a jaw adjustment mechanism for moving at least one of said jaws to clamp said baby bottle between said jaws and alternatively release said baby bottle from between said jaws; and further comprising two pairs of said jaws, and said jaws are all mounted upon support arms having side edges formed as toothed racks, wherein said toothed racks on said support arms in each pair of said jaws reside in mutually coplanar relationship facing each other, and said support arms for one of said pairs of jaws reside in a first support arm plane parallel to and longitudinally displaced from a second support arm plane in which said support arms for the other of said pairs of jaws reside and further comprising a pinion extending longitudinally between said first and second support arm planes and mounted for rotation in said base about a pinion axis of rotation perpendicular to both said support arm planes and passing through the center of said base, and said pinion has pinion teeth engaged with all of said toothed racks.

11. A detachable baby bottle accessory according to claim 10 further comprising a pinion latch mounted on said base and selectively engageable with and disengageable from said pinion to alternatively immobilize and permit rotation of said pinion on said pinion axis.

12. A detachable baby bottle accessory according to claim 11 further comprising a detent for selectively retaining said pinion latch engaged and disengaged with said pinion.

13. A detachable baby bottle accessory according to claim 10 wherein said jaws are each formed with concave inwardly facing surfaces that contact said baby bottle when said jaws clamp said baby bottle therebetween.

14. A detachable music box for a baby bottle comprising:

a body structure having a base for resting upon a horizontal surface to support said baby bottle thereon in a stable manner, a musical sound player housed within said body structure, and a bottle seat located at the top of said base and including a bottle clamp for gripping said bottle to thereby releasably secure said body structure to said baby bottle, and to alternatively release said body structure from said baby bottle, and wherein said bottle clamp is comprised of four clamping members, each formed with a jaw supported upon a clamp arm having an edge with a plurality of teeth formed thereon, and said clamping members are arranged in pairs with said jaws in each pair residing in opposition to each other and with said plurality of teeth on said clamp arms in each pair mutually parallel and in facing relationship relative to each other, whereby each of said clamp arms defines a linear toothed rack and further comprising guide slots in said body structure, wherein each of said jaws is mounted upon one of said transversely extending clamp arms and said clamp arms in each pair are disposed in mutual parallel alignment with each other and move in said guide slots formed in said body structure, and said pairs of clamping members are oriented at right angles relative to each other, and further comprising a single pinion mounted to said body structure for rotation relative thereto and engaged with all of said toothed racks and rotatable in a first direction to concurrently draw all of said jaws toward each other and alternatively rotatable in an opposite, second direction to concurrently push all of said jaws apart from each other.

15. A detachable music box according to claim 14 further comprising a manually actuatable latching mechanism mounted on said body structure and alternatively engageable with said pinion to immobilize said pinion from rotation relative to said body structure and disengageable from said pinion to permit said pinion to rotate relative to said body structure.

16. A detachable music box according to claim 15 further comprising a detent on said body structure to hold said latching member in selected alternative positions of engagement and disengagement relative to said pinion.

* * * * *